US005575004A

United States Patent [19]

Eisele et al.

[11] Patent Number: 5,575,004

[45] Date of Patent: Nov. 19, 1996

[54] REFLECTIVE SAFETY SASH

[76] Inventors: Jean M. Eisele; John F. Eisele, both of 1363 Old Toll Bridge Rd., Lakeland, Minn. 55043

[21] Appl. No.: 529,426

[22] Filed: Sep. 18, 1995

[51] Int. Cl.[6] ..... A41D 23/00

[52] U.S. Cl. ..... 2/1; 2/207

[58] Field of Search ..... 2/1, 207, 300, 2/309, 310, 338; 116/208, 278, 306, 307, 209; D2/835, 838, 843

[56] References Cited

U.S. PATENT DOCUMENTS

| | | | |
|---|---|---|---|
| 3,089,143 | 5/1963 | Jacobson . | |
| 3,276,416 | 10/1966 | Dirks et al. . | |
| 3,499,416 | 3/1970 | Thorsheim | 2/1 X |
| 3,901,579 | 8/1975 | Demerest .. | |
| 4,534,619 | 8/1985 | Bedford | 2/338 X |

FOREIGN PATENT DOCUMENTS

| | | | |
|---|---|---|---|
| 2397314 | 3/1979 | France | 2/1 |
| 2058547 | 4/1981 | United Kingdom | 2/1 |

*Primary Examiner*—C. D. Crowder
*Assistant Examiner*—Shirra L. Jenkins

[57] ABSTRACT

A sash is constructed of two fabric segments. A first fabric segment comprises reflective fabric to offer increased visibility to the wearer at night. The first fabric is mitered to an angle of between 75 and 115 degrees at midpoint where it rests on the hip of the wearer. A second fabric segment is attached to ends of the reflective fabric to form a support segment which would lie on the shoulder of the wearer. The support segment is attached to the first section at an angle of between 110 and 165 degrees so that the support segment will lie flat on the shoulder of the wearer. The combination of the mitered angle at the midpoint of the first fabric and the angle at the point of attachment of the reflective fabric and the support segment provide a design which lies flat on the torso of the wearer so that the reflective fabric is oriented properly for optimal viewing.

7 Claims, 1 Drawing Sheet

REFLECTIVE SAFETY SASH

BACKGROUND OF THE INVENTION

1. Field of the Invention

The present invention relates to protective apparel and in particular to apparel which reflects light so as to protect the wearer by providing visibility at night.

2. Background of the Art

Many accidents to pedestrians and bike riders occur at night because of their low visibility to motorists. Many safety organizations promote the use of at least lightly colored clothing at night, and for the truly safety conscious, reflective apparel is available. This reflective apparel has strips of materials strategically sewn onto the article of clothing so that light from headlamps or street lights is reflected, giving higher visibility to the wearer.

Materials are available commercially which can be sewn onto articles of clothing to add reflective strips to any other article of clothing. Reflective strips are also available which can be pasted or adhered to clothing without the need for sewing. These materials provide enhanced night visibility, but sewing is a permanent attachment, may be difficult for many people to do, and can damage the article of clothing if the reflective material is ever to be removed. Likewise if the reflective material is adhered to the clothing by adhesives, damage is very likely upon removal of the reflective material from the clothing.

A simple waist encircling belt of reflective material can be worn, but athletic gear (such as sweatshirts) may ride over a firmly secured belt and obscure the reflective surface. Sashes, such as sashes worn by pageant contestants, may have reflective materials on them, such as metallic lettering, but such sashes tend to slip and do not ride uniformly, possibly twisting so as to again obscure the reflective surface.

Vests have been fashioned which include strips of reflective or retroreflective material attached to them. These vests have the disadvantage of being bulky, and by covering a major part of the wearer's torso to provide limited areas of reflectivity, are obtrusive. In addition these vests usually require the use of ties, buttons, or snaps to keep them in place.

SUMMARY OF THE INVENTION

A reflective sash is provided with two distinct fabric areas. The first fabric area comprises a fabric material, at least a portion of which is light reflective or retro-reflective and which first fabric area is intended to provide reflectivity to the wearer of the sash. This first fabric area should cover a sufficiently large portion of the exposed body with reflective material (e.g., a strip at least one foot long and one inch wide) so as to provide sufficient reflectivity to afford a level of safety to the wearer. The first strip preferably has an angle of between 75 and 105 mitered into it at about the mid point and is secured around the body by a second strip extending off a section of the first strip at an angle between 15 and 75 degrees as measured from the axis of the first strip. The second strip is designed to rest on the shoulder of the wearer, approaching a flat lay on the shoulder of the wearer. The second strip, often secured to the two ends of the first strip, completes a circular-like sash, with the second strip intended to lie over a shoulder and support the first strip, the first strip encircling the torso, passing from below the shoulder towards and around a hip or waist, with the angled miter resting approximately on the hip of the wearer.

DETAILED DESCRIPTION OF THE INVENTION

Figure 1:
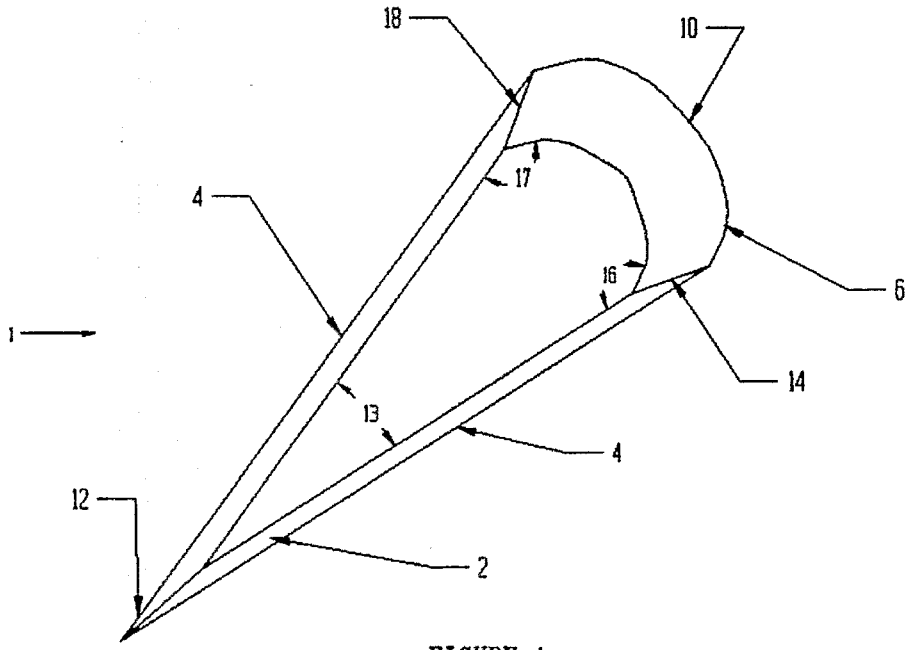
FIG. 1 which shows a perspective view of sash 1 of the present invention.

The reflective sash material of the first fabric material may be constructed of any reflective fabric material. Sasheen™, brand name for gift wrap ribon made with a non woven acetate fabric with reflective threads, fabric with adhered glitter, fluorescent or phosphorescent colored fabric, fabric with retro-reflective beads, fabric with retro-reflective cube corners, fabric with reflective metallic threads, and any other variety of reflective material may be used as the reflective fabric of the present invention. The most preferred fabric is Scotchlite™ manufactured by Minnesota Mining and Manufacturing Co., St. Paul, Minn. This first fabric material may be cut into a strip of appropriate length to be worn as a sash about one shoulder to the opposite hip of a person. This first fabric material may have an angle of between 75 and 105 degrees mitered into it at midpoint so that it rests on the hip and allows the reflective fabric to lay flat on the torso of the wearer. An adjustable slide may be included on the sash, so that its length may be adjusted, but the article may be commercially provided in various lengths to fit approximate consumer sizes as determined by the market. Only one side of the first fabric needs to be reflective.

The second fabric material may be any fabric material which meets the structural strength needs of a relatively short support strip. This second fabric is a short strip of material which is sewn onto the two ends of the strip of first fabric to complete a loop which acts as a sash. The sewn, or otherwise attached connection of the two fabric materials, is such that a definite angle of between 15 and 80 degrees is formed between the edges of the two fabric materials. This angle is necessary to provide a firm support on the shoulder by the second fabric without twisting the first fabric. The midpoint hip miter also is important in assisting to get good lay flat properties.

Although the second fabric material may be any fabric material capable of providing the strength necessary to support the first fabric material without tearing, it is desired that additional properties be provided by the second fabric material. Many reflective fabrics have very smooth, and therefore very slippery surfaces, both on the reflective surface and the internal (back surface) surface. If such a material were used as the second fabric material, the section lying over the shoulder would not provide good friction securement to the shoulder. The sash would then tend to slide, reducing the benefits of the designed fit of the sash to the shoulder and body. It is therefore desired that at least the internal surface of the second fabric, that surface which would contact the shoulder of the wearer, comprises a material which would exhibit good static friction against the surface of the shoulder or fabric worn on the shoulder. This would not require anything as tightly securing as Velcro™, and Scotchmate™, both of which are hook and loop type fasteners or adhesives (although repositionable adhesives might well serve such a use), but a coarse or rough fabric would be desirable. A coarse cloth, weave, knit or other rough fabric would be suitable for this use. Fabric with light abrasive particles to increase the friction against the surface would also be useful.

Figure 2:
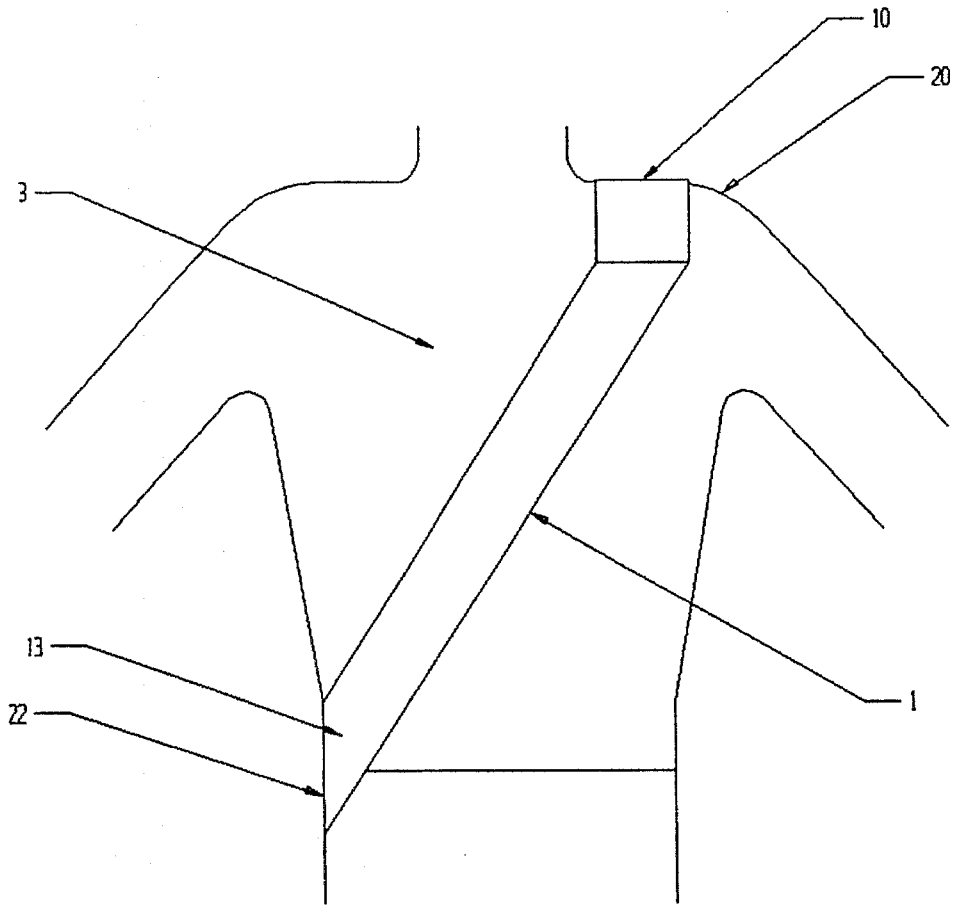
FIG. 2 shows a sash 1 of the present invention as worn by a runner 3.

Referring to FIG. 1, the invention can be further described. The sash 1 comprises two parts: a first fabric forms the reflective portion 2 of the sash 1 and a second fabric material forms the support segment 6 of the sash 1. The reflective portion 2 and the support segment 6 form a loop which is the sash 1. A miter at the midpoint 12 of the first fabric of between 75 and 105 degrees of the reflective portion 2 would overlay a hip (not shown). The miter at 12 may be sewn, stitched, heat sealed, ultrasonically welded, stapled, adhesively secured or the like. The internal surface 4 of the reflective portion 2 of the sash 1 does not have to be reflective. The reflective portion 2 of the sash 1 connects to the support segment 6 of the sash 1 at seams 14 and 18. Seams 14 and 18 may be sewn, stitched, heat sealed, ultrasonically welded, stapled, adhesively secured or the like. ((The second fabric material in the support segment 6 forms seams 14 and 18 at ends of the first fabric strip 2.)) An angle 16 is formed between the first reflective fabric strip 2 and the second fabric material of the support segment 6 and similarily an angle 17 is formed between the the other end of the first reflective fabric strip 2 and the other end of the second fabric material of the support segment 6 as shown in FIG. 1. Angles 16 and 17 may be equal for a given design of the sash. The combination of the angle 13 at 12 and angles 16 and 17 has been found to be important for achieving a flat lie of the support segment 6 of the sash 1. The angles 13 and 16 and 17 are dependent upon the size and shape of the wearer. Angle 13 must be between 75 and 105 degrees, as the sash rests on the wearer, as shown in FIG. 2, more preferably between 85 and 95 degrees measured on the inside angle of the miter. Angle 13 is less critical as it may form an arcuate passage around the hip of the wearer. Angles 16 and 17 must be between 15 and 80 degrees, more preferably between 25 and 65 degrees, as measured away from the axis of the first fabric material 2. The actual measured angle between the two fabric strips 2 and 6 would therefore be between 110 and 175 degrees. The internal surface 8 of the support segment 6 would be the surface that should have a useful static coefficient of friction to prevent the sash 1 from slipping, particularly at the highest point 10 where the sash 1 would lie on a shoulder.

An alternative means for forming the first strip is to fold a sheet of reflective surface with the reflective surface on the outside of the folded fabric. The strip may be cut (by die, cloth cutter or scissors, for example) so that the first strip does not need to be sewn or mitered at the fold. The angle of the cut would be appropriate to cream the same angles, configuration, and lie of the fabric, as if it were mitered. The angle between the fold line and the long edge of the strip (running towards the shoulder) would be that desired in the design of the mitered construction. Those angles (as measured from the fold line) would be approximately 40 to 75 degrees at the top edge and 105 to 140 degrees at the bottom edge. Such a fabric could be cut directly from a single folded sheet without mitering or stitching at 13.

FIG. 2 shows a sash 1 of the present invention as worn by a runner 3. As can be seen in this Figure, the highest point 10 of the sash 1 sits securely on a shoulder 20 of the runner 3, while the miter 12 of the sash 1 rests on a hip 22.

What we claim is:

1. A sash to be worn on the human body, said sash comprising two fabric sections: a first and longer fabric section having a reflective surface on at least one surface of said first fabric and which is mitered at midpoint to form an angle of 75 to 105 degrees, and a second and shorter fabric section being attached to two ends of said first fabric section to form an angle of between 110 and 165 degrees between the first and second fabric sections.

2. The sash of claim 1 wherein said fabric sections are attached by sewn seams.

3. The sash of claim 1 wherein said sash is in the form of a fabric which forms a loop.

4. The sash of claim 1 wherein a surface of said second fabric which faces inwardly, away from said reflective surface, has a higher static coefficient of friction against skin than does said reflective surface.

5. The sash of claim 1 wherein said first fabric section and said second fabric section comprise different fabric materials.

6. The sash of claim 4 wherein said first fabric section and said second fabric section comprise different fabric materials.

7. The sash of claim I wherein said first fabric can, when folded, overlay itself to form two layers, the angle between the fold and long edges of said first sheet being between 40 and 75 degrees at the top edge and 105 to 140 degrees at the bottom edge.

* * * * *